US005348279A

United States Patent [19]

Lambregts et al.

[11] Patent Number: 5,348,279

[45] Date of Patent: Sep. 20, 1994

[54] METHOD AND DEVICE FOR STAPLING STACKS OF SHEETS

[75] Inventors: Augustines W. M. Lambregts; Johannes H. P. Remmen; Hubertus G. A. Deckers, all of Venlo, Netherlands

[73] Assignee: Oce-Nederland, B.V., Ma Venlo, Netherlands

[21] Appl. No.: 29,587

[22] Filed: Mar. 11, 1993

[30] Foreign Application Priority Data

Mar. 27, 1992 [NL] Netherlands ..... 9200570

[51] Int. Cl.[5] ..... B42C 1/12

[52] U.S. Cl. ..... 270/53

[58] Field of Search ..... 270/53, 58; 355/324 X

[56] References Cited

U.S. PATENT DOCUMENTS 4,762,312 8/1988 Ushirogata ..... 270/53
4,928,941 5/1990 Uto et al. ..... 270/53
5,255,902 10/1993 Coombs ..... 270/53

FOREIGN PATENT DOCUMENTS 59-69346 8/1984 Japan .
4-47989 2/1992 Japan ..... 270/53
4-47990 2/1992 Japan ..... 270/53
2227733 8/1990 United Kingdom .

OTHER PUBLICATIONS

62244869 Apr. 1988 Japanese Abstract.
3234596 Jan. 1991 Japanese Abstract.

*Primary Examiner*—Edward K. Look
*Assistant Examiner*—John Ryznic
*Attorney, Agent, or Firm*—Birch, Stewart, Kolasch & Birch

[57] ABSTRACT

Method and device for stapling stacks of sheets situated in bins placed one above another in parallel with a stapler movable along the bins, the stapler being rotatable about an axis of rotation so as to move the stapler at each bin from an inoperative position, in which the stapler is turned away from the bins, to an operative position, in which the stapling elements of the stapler surround an edge portion of the stack of sheets to be stapled, the stapler having a pressure surface which, during this rotatory movement, pushes to one side of an adjacent bin a stack of sheets already stapled and positioned in the adjacent bin.

5 Claims, 3 Drawing Sheets

METHOD AND DEVICE FOR STAPLING STACKS OF SHEETS

BACKGROUND OF THE INVENTION

1. Field of the Invention

The invention relates to a method of stapling sheets situated in parallel bins and to a device related thereto.

2. Description of the Related Art

There are known from United Kingdom patent application 2,227,733 and from Japanese patent application 59-69346 various methods and devices sheet stapling. To enable stapling in the device described in the UK patent application, each stack of sheets lying in a bin is gripped by a gripper, partially pulled out of the bin and brought into contact with the stapler which has been placed in the stapling position next to that bin. After stapling, the stapled stack of sheets is pushed back into the bin and the stapler is moved to the following bin. Thereafter, the gripper grips the next stack of sheets and moves the stack of sheets in that following bin to the stapling position. A disadvantage of this known device is that in order to be able to staple a yet unstapled stack of sheets, the stack of sheets has to be moved from the position originally occupied in a bin to another position. By gripping and moving a stack of unstapled and therefore loose sheets lying on top of one another, there is always the danger that the sheets may shift relative to one another and subsequently be attached to each other in a shifted position. In the device described in the Japanese patent application, the position occupied by a stack of sheets in the stapling position corresponds to the original position occupied by the stack in that bin. However, in order to ensure that the stapler, which viewed in the direction of the width of a bin is wider than the normal bin width can surround the edge portion of a stack of sheets situated in that bin, the bin width must be increased when the stapler is moved to the stapling position at that bin. A disadvantage of this device is that the increase requires more space and extra components for each bin.

SUMMARY OF THE INVENTION

Therefore, it is an object of the present invention to provide a sheet stapler which will overcome the above-noted disadvantages.

It is a further object of the present invention to provide a device for stapling copy sheets situated in parallel storage bins.

Still a further object of the present invention is to provide a sheet stapling device which is moved relative to each parallel sheet storage bin.

The foregoing objects and others are accomplished in accordance with the present invention, generally speaking, by providing a device and method whereby when the stapler is placed in the stapling position in a bin, a stack of sheets already stapled and positioned in an adjacent bin is displaced. As a result, adjacent stacks of sheets for stapling can remain at the same short distance from one another, even when they are stapled with a stapler, which, viewed in a direction perpendicular to the sheet surface, is larger than the distance between two stacks of sheets lying on both sides of the stack to be stapled. The stapler is movable between an inoperative position in which the stapler is away from the bins and an operative position in which the stapling element of the stapler surrounds edge portions of a stack of sheets positioned in a bin, the stapler has a pressure surface for the displacement a stack of sheets positioned in another bin, which pressure surface in a direction perpendicular to the stack surface is situated at a distance from the stapling element corresponding to the distance between adjacent bins and, in the operative position of the stapler, in a direction parallel to the stack surface, the pressure surface is situated closer to the bins than the stapling element of the stapler. As a result, a compact device is realized which has a minimum number of components for stapling straight stacks of sheets positioned in bins.

In an embodiment of a device in accordance with the present invention, the stapler is rotatable about an axis of rotation for movement between its inoperative and operative positions and when in its inoperative position the stapler is situated adjacent to one side the stacks of sheets positioned in bins. As a result, when the stapler is in its inoperative position, stacks of sheets can easily be taken from the bins along the stapler without the stapler hindering this operation. In addition, as a result of the pressure surface forming an acute angle with the plane in which the axis of rotation of the stapler and the stapling element lie, the pressure surface presses against the stack in a direction parallel to the above-mentioned side of a stack of sheets, when the pressure surface comes into contact with a stack of sheets, whereby there is little risk of the stack of sheets being displaced out of alignment.

BRIEF DESCRIPTION OF THE DRAWINGS

Other characteristics and advantages of the invention will be clarified by means of the accompanying drawings, wherein.

DETAILED DESCRIPTION OF THE INVENTION

Figure 1:
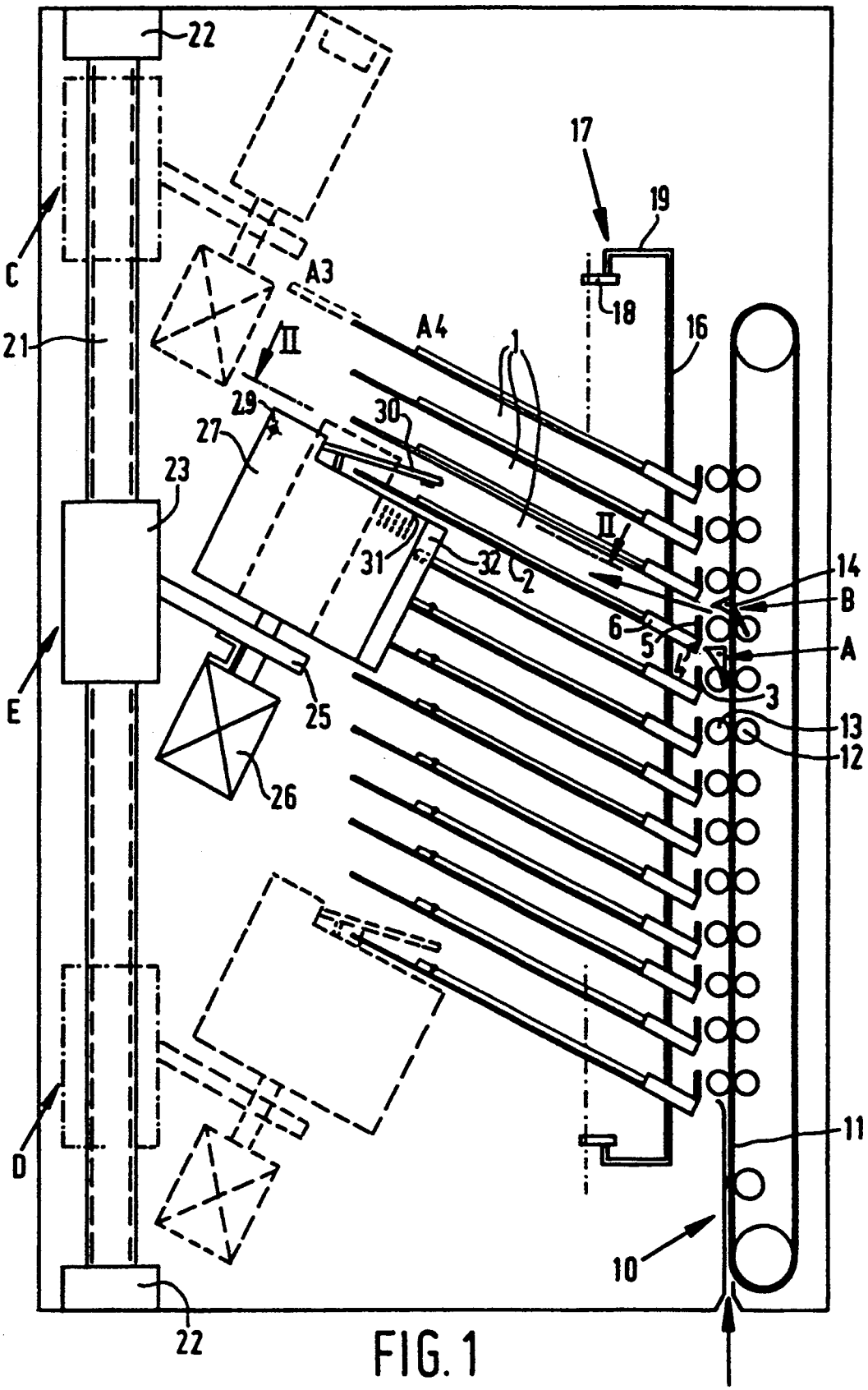
FIG. 1 is a front elevation of a device in accordance with the present invention.
Figure 2:
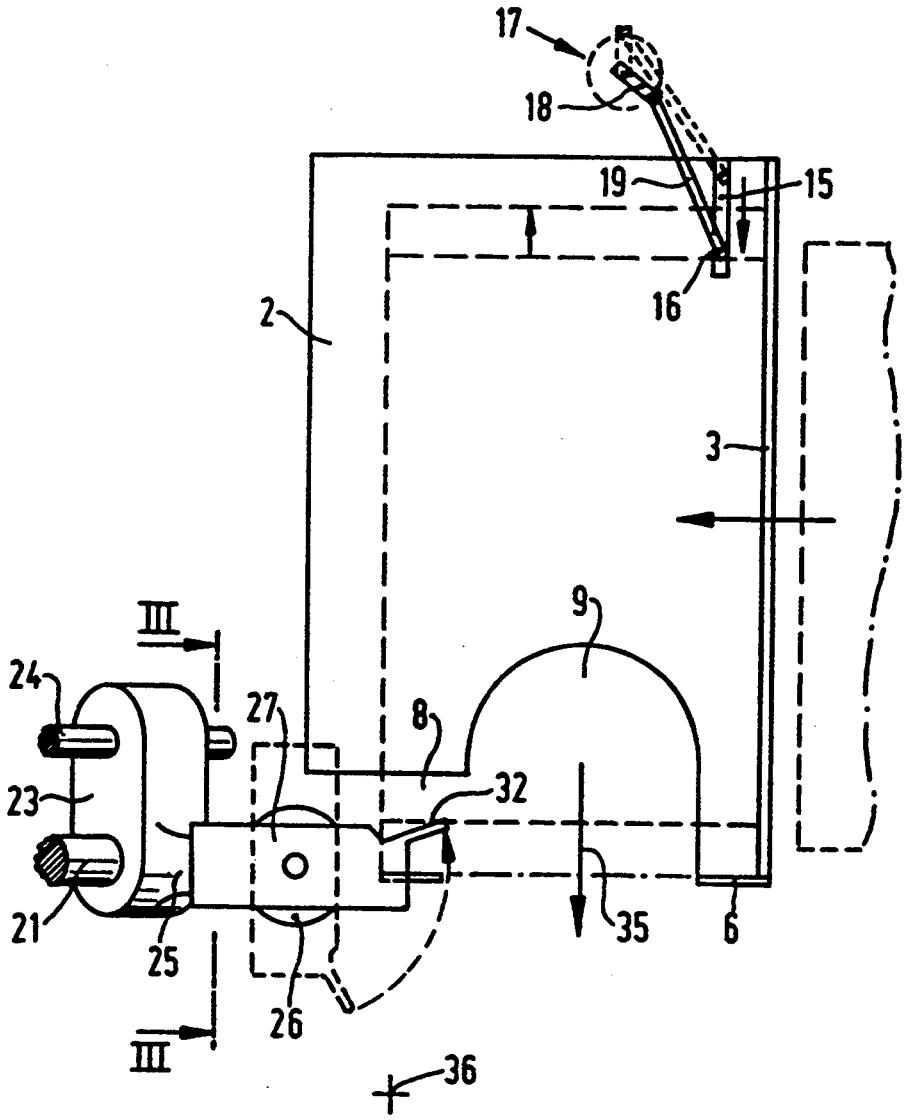
FIG. 2 is a cross-section in top plan view of the device shown in FIG. 1, viewed along line II—II in FIG. 1.

The device shown in FIG. 1 comprises a number of bins 1 situated one above the other into which sheets coming from a photocopier can be deposited in a sorted way. Each of the bins shown is formed by a rectangular base plate 2 which is at an angle of about 27.5 to a horizontal plane. The parallel base plates 2 lie at a short distance from each other, for example at a distance of about 30 mm, so as to make each bin available for the collection of a stack of approximately 75 sheets of, for example, 80 g/m2 paper. As shown in FIG. 1, for one bin, each sloping base plate 2 is fitted on its lowest side with a raised edge 3 which extends over the whole length of the bin. The raised edge 3 is composed of a section 4 which is attached to the base plate 2 at an angle of 90 and which is approximately 5 mm high, and a section 5 which is attached to section 4 and which extends vertically over a distance of approximately 15 mm. Each base plate 2 is fitted on a front edge with a raised edge 6 which, like the section 4 to which it is attached, is also approximately 5 mm high. The raised edge 6 extends over only a small section of the edge of the base plate 2. The rest of this sloping edge section lies back relatively to the raised edge 6. As shown in FIG. 2, recesses are formed in a corner section 8 and a middle section 9 of the front side of each base plate 2, to enable the stacks of sheets lying on the base plate 2 to be reached from below to enable stapling and the removal of those sheets.

Adjacent to the lowest sides of the bins 1, a sheet transport system 10 is provided for the supply of sheets to these bins 1 and the selective feeding of these sheets into one of these bins 1. The transport system 10 consists of a transport belt 11 which, in a vertically running trajectory, is pressed by pressure rollers 12 against transport rollers 13. Deflectors 14 at each bin can be set selectively in either a non-active position (A) or an active position (B), in which latter position a sheet is deflected from the transport belt 10 and is fed over raised edge 3 into the relevant bin. After a sheet has completely passed this raised edge 3, it slides back due to the influence of gravity and a small air cushion under the sheet until it stops with an edge against the raised edge 3. The first 25 sheets come in this way to a standstill against section 4 of the raised edge 3 so that the stack made up of these sheets,viewed in the direction of feed, is straight and hence ready for stapling. Sheets subsequently fed into a bin stop against section 5 of the raised edge 3, the enclosed acute angle between edge section 5 and the base plate 2 preventing the sheets from easily being displaced over the raised edge.

Figures 3A, 3B, 3C:
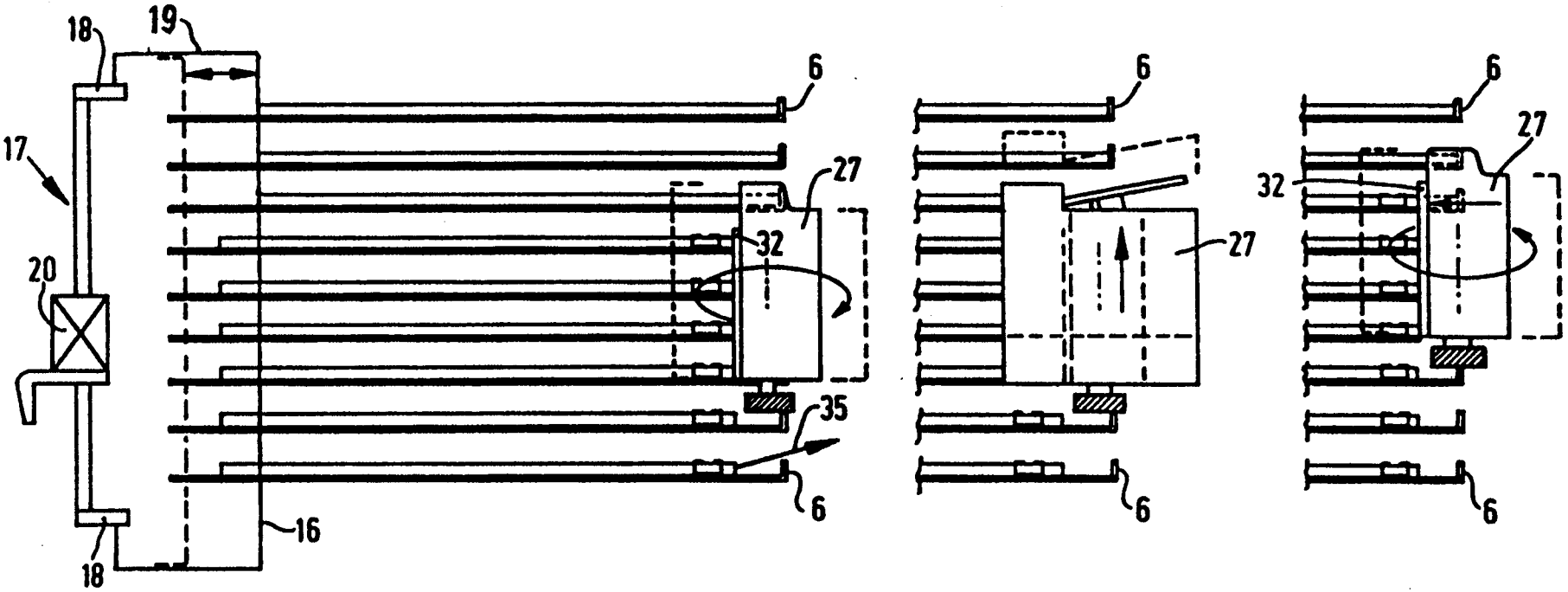
FIG. 3A is a cross-section in a side elevation view of the device shown in FIG. 2, viewed along line III—III, with the stapler in the stapling position.
FIG. 3B shows a part of the side elevation view of FIG. 3A with the stapler in a position between two consecutive stapling positions.
FIG. 3C shows the same part as FIG. 3B with the stapler in a following stapling position.

The transport system 10 feeds each sheet into such a position in a bin that a side edge of that sheet remains a short distance away from raised edge or side stop 6, for example at a nominal distance of 5 mm. On the side of the base plate opposite to the raised edge or side stop 6, each base plate 2 has a slot 15 which extends in a direction parallel to the raised edge 3. A vertical rod 16 protrudes through these respective slots 15, and, by means of a crank and connecting rod mechanism 17, with crank 18 and connecting-rod 19, as shown in FIG. 2 and 3*a*, can be pushed backwards and forwards in the slot 15. For this purpose, a motor 20 is activated each time a sheet is fed into a bin, to make one revolution, during which rod 16 moves from its rest position, shown by broken lines, to an active position, shown by solid lines, and returns to its rest position. During the movement from the rest position to the active position, rod 16 pushes the fed sheet against the raised edge 6 for the formation of a straight stack of sheets in the bins also in a transverse direction to the direction of feed.

On the sides of the bins 1 remote from the raised edges 3, there is a screw spindle 21 which is rotatably borne at the ends in bearing blocks 22 which are situated under and above the bins and which spindle 21 can be rotated by drive means (not shown). A nut 23 cooperates with this screw spindle 21, and moves up or down when the screw spindle is rotated. A rod 24 which protrudes through a hole in nut 23 parallel to the screw spindle 21 prevents the nut 23 from rotating during its up or down movement. Nut 23 has a flat protrusion 25 which extends in the direction of the bins and parallel thereto. Attached to the underside of the protrusion 25 is a motor 26, the outgoing shaft of which is borne in the protrusion 25 and carries at its end an automatic stapling device or stapler 27, which is fitted with an anvil 30 which is rotatable about axis 29, and a fixed stapling head 31. Such a stapler, for example of the Swingline Zephyr type, is in the form of a flat box whose thickness is determined by the length of the backs of the staples. Dimensions in the other directions are larger on account of the housing of the drive mechanisms for the stapling head 31 and the anvil 30. By rotating the screw spindle 21 in one direction, the stapler 27 can be moved from a top stand-by position, which is shown in FIG. 1 by C, to a bottom position which is shown by D, from which latter position the stapler 27 can be given a quarter turn by driving motor 26 so as to be in the stapling position. By turning the screw spindle 21 in the opposite direction, the stapler 27 can be moved in stages from position D at the lowest bin to the bins above the lowest bin, as shown in FIG. 1, where E indicates a position for an intermediate bin. During the movement of the stapler 27 in a vertical direction, the stapler assumes a position which is shown by broken lines in FIG. 1 at positions C and E. In this position the thickness of the box-shaped stapler 27 lies parallel to the raised edge 6 and the trajectory of the stapler 27 is in a vertical direction completely outside the stacks of sheets to be stapled and deposited in the bins. After the stapler 27 has moved downwards from its stand-by position C to adopt position D, in which latter position the anvil 30, viewed relative to the bin in which the stack lies, lies higher than the stack and the stapling head 31 lies lower, the stapler 27 is moved by a quarter turn by means of motor 26 and comes to occupy the position shown by solid lines in FIG. 2, in which position a corner section of the stack of sheets lies between the stapling head 31 and the anvil 30. By activation of the driving mechanism in the stapler 27, the movable anvil 30 then presses the stack against the stapling head 31 which is situated at a short fixed distance below the base plate 2 and then presses the legs of a staple through the sheets, whereafter the anvil 30 presses the legs flat against the top of the stack of sheets.

For stapling stacks of sheets in the bins situated above the lowest bin, the following cycle is subsequently carried out each time:

1-activation of motor 26 for the quarter turn of the stapler 27 (FIG. 3A), 2-rotation of the screw spindle 21 to raise the stapler 27 by a distance of one bin (FIG. 3B), and 3-further activation of motor 26 for the return quarter turn of the stapler 27 (FIG. 3C).

When the stapler rotates back at a bin situated above the lowest bin, a pressure surface 32 (see FIG. 2), which is formed on the stapler, comes into contact with the stapled stack of sheets lying in the bin below and pushes this to one side in a direction parallel to the raised edge 3 and for a distance of, for example approximately 25 mm, to the position shown by broken lines in FIG. 2. As shown in particular in FIG. 2, the pressure surface 32 is at an angle to the lateral surface of the stapler 27. The size of this angle has been chosen in such a way that during the turning of the stapler to the stapling position, the pressure surface 32 at one point in time lies in the same plane as the raised edge 6. This prevents the stapled stack of sheets from being pushed out of line when being moved sideways.

By displacing a stack of sheets after stapling, it is possible, on the one hand, to use a stapler which is higher than the distance between the bins, and, on the other hand, to choose a distance between the bins less than the height of automatic staplers in standard use, such as the Swingline Zephyr, with a capacity of 25 sheets. After the uppermost stack of sheets has been stapled, the above-mentioned cycle can be repeated once more in order also to displace this last stack of sheets to one side so as to achieve a uniform positioning of stapled stacks of sheets to be removed. The stapled and displaced stacks of sheets with a maximum thickness of 2.5 mm which are lying in the bins, now lie 25 mm behind the 5 mm high raised edge 6 and can thus be easily removed by hand from the bins without having to make the raised edge 6 collapsible. The hand merely has to move backwards at an angle of about 15° upwards. In addition to the stapling of stacks of predetermined sized sheets placed squarely in bins, for example A4 sheets, the device shown in the diagrams is also suitable for sheets of a larger size, for example up to size A3 and the formation of a thicker stack of sheets, for example 75 sheets. In these latter instances the crank and connecting-rod mechanism 17 and the stapler 27 remain in the rest position and stand-by position respectively. With the device shown in the diagrams a stack of rectangular sheets of, for example, A4 size, is stapled in the top left-hand corner with the back of the staple parallel to the long side and the stapled stack of sheets is removed in the direction indicated by arrow 35. It will be clear that a device in accordance with the present invention can also be set up for the application of staples in a direction parallel to the short side of the A4 and the removal of the stapled stacks of sheets in a direction parallel to the short side, for example, by placing the screw spindle shaft 21 in the position indicated by reference 36 in FIG. 2 and making a recess in the base plate 2 on the side remote from the raised edge 3. The stapled stack of sheets can also be moved aside to bring the stapling head in a stapling position for the stack of sheets situated in a following bin, by a rectilinear movement instead of a rotatory movement, for example, by connecting the stapler, by means of a horizontally extending linear guide to a support for the stapler, being movable by stages in the vertical direction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for stapling stacks of sheets in parallel bins, comprising:

a plurality of bins having a surface for storing stacks of sheets, and a stapler movable in a vertical direction with respect to said bins to a position adjacent to two of said bins, said stapler at said adjacent position being rotatable about an axis perpendicular to said surface of said bins between an inoperative position and an operative position, said stapler being provided with a pressure surface such that when said stapler is in said operative position, a stack of sheets in one of said adjacent bins is displaced by said pressure surface in a direction along said bin surface while a stack of sheets in the other of said adjacent bins is stapled by said stapler.

2. An apparatus in accordance with claim 1, wherein said stapler, when in its inoperative position, is situated, seen in a direction transverse to said direction of displacement, outside said stacks of sheets positioned in said bins.

3. An apparatus in accordance with claim 1, wherein said pressure surface forms an angle with a lateral surface of said stapler.

4. An apparatus as in claims 1, 2 or 3, further including a means for applying pressure to sheets stored in said bins, said means being disposed on a side of said bins remote from that side where said pressure surface is situated in said operative position, and comprises a pressure element which is movable between a position in which said pressure element presses sheets lying in said bins against a side stop and a position in which said pressure element is free of sheets which are displaced away from said side stop by said pressure surface.

5. A method of stapling stacks of sheets in parallel bins of a sheet stacking apparatus with a stapler which can be moved into a stapling position relative to each bin, the method comprising:

positioning said stapler into a stapling position adjacent to two of said bins, rotating said stapler about an axis perpendicular to a sheet support surface of said bins between an inoperative position and an operative position, placing a staple in a stack of sheets in one of said adjacent bins while said stapler is in said operative position, and displacing a stack of sheets in the other of said adjacent bins along said support surface while rotating said stapler to said operative position.

* * * * *